United States Patent [19]

Prosser

[11] Patent Number: 5,065,032

[45] Date of Patent: Nov. 12, 1991

[54] THERMAL INTEGRATED TARGET

[75] Inventor: Paul L. Prosser, Chapin, S.C.

[73] Assignee: Custom Training Aids, Swansea, S.C.

[21] Appl. No.: 579,619

[22] Filed: Sep. 10, 1990

[51] Int. Cl.[5] ..... F41J 1/00

[52] U.S. Cl. ..... 250/495.1; 250/493.1; 250/504 R; 273/348.1

[58] Field of Search ..... 250/495.1, 494.1, 493.1, 250/504 R; 428/919; 273/348.1

[56] References Cited

U.S. PATENT DOCUMENTS

| | | | |
|---|---|---|---|
| 4,253,670 | 3/1981 | Moulton et al. | 273/348 |
| 4,279,599 | 7/1981 | Marshall et al. | 273/348 |
| 4,346,901 | 8/1982 | Booth | 250/504 R |
| 4,405,132 | 9/1983 | Thalmann | 273/348.1 |
| 4,524,386 | 6/1985 | Scott | 358/113 |
| 4,605,232 | 8/1986 | Hundstad | 273/348.1 |
| 4,606,802 | 8/1986 | Kobayashi et al. | 204/192 R |
| 4,634,293 | 1/1987 | D'Agostino et al. | 250/316.1 |
| 4,659,089 | 4/1987 | Rosa | 250/495.1 |
| 4,767,122 | 8/1988 | Rushe | 273/348.1 |
| 4,792,142 | 12/1988 | Davies | 273/348.1 |
| 4,883,971 | 11/1989 | Jensen | 250/495.1 |

*Primary Examiner*—Jack I. Berman
*Assistant Examiner*—Kiet T. Nguyen
*Attorney, Agent, or Firm*—F. R. Brockington

[57] ABSTRACT

A thermal target which produces and emits an infrared image that simulates heat emitting equipment or personnel, wherein said image is formed by an electric current passing through a heatable resistive coating integral with the target, wherein said thermal target is comprised of a structural sheet, that is weather resistant and flame resistant, which is covered with an insulative coating onto which is applied an electrically resistive coating, which when heated creates an infrared image, where said resistive coating is in electrical contact with a conductive coating which distributes current over the target and is in electrical contact with a power supply.

10 Claims, 4 Drawing Sheets

THERMAL INTEGRATED TARGET

FIELD OF TECHNOLOGY

Invention relates generally to ballistic targets and more particularly to ballistic targets that simulate objects that are thermally emitting and therein themselves detectable using infrared sensors.

BACKGROUND OF THE INVENTION

Infrared sensors are used to detect equipment and personnel that would otherwise be invisible either because of camouflaging or due to an insufficiency of visible light. The infrared sensors are able to profile the thermal topography of a region through amplification and analysis of the light emitting in the infrared region of the light spectrum. Temperature deviations of less than ½ F above the ambient temperature, can be discerned. The infrared technology is often incorporated by the military into an array of weapon systems to spot, tract and align guidance systems and sights of a weapon onto a radiant heat source, such as equipment or personnel. Thermal imaging using infrared detectors is accurate enough to identify not only the position of the radiant heat source, but also details specific enough to distinguish signature morphological features. To practice identifying and shooting potential targets the military uses training aids that simulate real life equipment and personnel. The training aids can be two or three dimensional, full or scalar reproductions of the simulated objects. To simulate the heat actually generated by the equipment or personnel, the training aids or targets must themselves give off a comparable amount of energy. A method to affect this thermal image is to use targets that are covered with a type of electric blanket, where the blanket is heated and shaped so as to imitate the heated, more distinguishing thermal surface features of the simulated object.

Thermal targets are typically erected on a firing range for gunnery practice at some future date. On the range a number of practical problems have been encountered that require inexpensive solutions. Thermal targets simulating large pieces of equipment tend themselves to be both expensive and massive, requiring several people and multiple pieces to assemble. Thermal targets using an electrical system to produce a thermal image are frequently sensitive to climatic conditions, and are on the whole not sufficiently dependable. The target should be able to be hit with a number of rounds and still retain its thermal image to the extent that its thermal features or signature is still intact and discernible. The target must hole cleanly, independent of the shell size, and be fire resistant.

SUMMARY OF THE INVENTION

The invention is a process for fabricating thermal targets, either two or three dimensional, scalar or full size, wherein the thermal image emitting from the target is of sufficient detail and accuracy as to simulate the "signature" thermal image of the actual object, where the actual object is either a piece of equipment or personnel. The thermal image is created substantially on the surface of the target using a system of electrically conductive and resistive and insulative coatings which are integral with the target, wherein the resistive coating heats when an electrical current is passed through it. Resistive coatings are applied to the target such that they affect the signature thermal image of the simulated object. An object of the invention is that the electrically conductive and resistive coatings are applied in combination with an electrically insulative coating onto the surface of the target such that a signature thermal target is produced that can take a large number of hits before significantly degrading the thermal image.

Another object of the invention is, that when hit, the target will hole cleanly, and will be retardant to fire.

Another object of the invention is that the target will have good storage stability and function under most climatic conditions.

Another object is that the thermal signature will be integral with the target, not requiring assembly of multiple components.

A final object is that the target is comprised of relatively light weight, inexpensive materials, and the target is fabricated such that only minimum man power is required for assembly.

The process and materials drawn to these objects is given below.

The target is cut out so that its perimeter generally matches the profile of the simulated object.

The target is comprised of one or more structural sheets onto which have been applied a combination of electrically conductive, resistive and insulative coatings applied to the surface of the structural sheet. The structural sheets can be planarly combined to form a two dimensional target, or isometrically to form a three dimensional target. Two Dimensional targets are the usual case. The material comprising the structural sheet of the target is usually a wood or plastic laminate having a high strength to weight ratio, where the wood or plastic laminate is fire resistant and has good weatherability, either intrinsically or as a consequence of subsequent treatment with the appropriate coatings applied to and impregnated in the structural sheet. The thermal signature image is prepared as follows. The heat emitting surface of the target is covered with an electrically insulative coating, which makes the heat emitting surface electrically insulant. The insulative coating acts as an electrical insulator. Onto this insulant frontal surface is sketched the desired thermal image. An electrically resistive coating is applied pattern-like to those areas that are to heat. The resistive coating heats when an electric current passes through it. An electrically conductive coating is applied to the insulant frontal surface such that the perimeter of the pattern formed by the resistive coating is just overlapped by and in electrical contact with the conductive coating. The conductive coating acts as an electrical bus to the heat emitting patterns. The rear non-heat emitting surface of the target is laid out electrically similar to a double sided circuit board. The electrically conductive coating is applied so as to enable connection of the conductive coating on the heat emitting front surface through the structural sheet to the conductive coating on the non-heat emitting rear surface. Connections through the structural sheet, front to rear, are made using interconnecting conductive elements such as nails, screws, wires, pegs, et cetera. The electrically conductive coating on the rear surface is applied in very wide bands, and, in general, are much wider than the electrically conductive coating on the front of the target. There are multiple conductive elements interconnecting the front and rear conductive coatings, and the conductive elements are dispersed in as wide a breadth as is possible. This configuration of conductive coatings interconnected with multiple conductive elements assures that there will most likely still be an electrical connection across the resistive coating even after the target has been hit multiple times, because no single hole will be large enough to completely obliterate the rear conductive coating, and as the rear coating is connected through multiple conductive elements to the front conductive coating an electrical path, no matter how circuitous, will still be intact.

The appropriate conductive coating of the target is each fitted with at least one electrical terminal for connection to the power supply.

The front of the structural sheet is covered with another insulative coating. The rear of the structural sheet is covered with an insulative coating. The target is painted in colors appropriate for the simulated object, usually a non-reflective paint.

DETAILED DESCRIPTION OF THE PREFERRED EMBODIMENT

Figure 1:
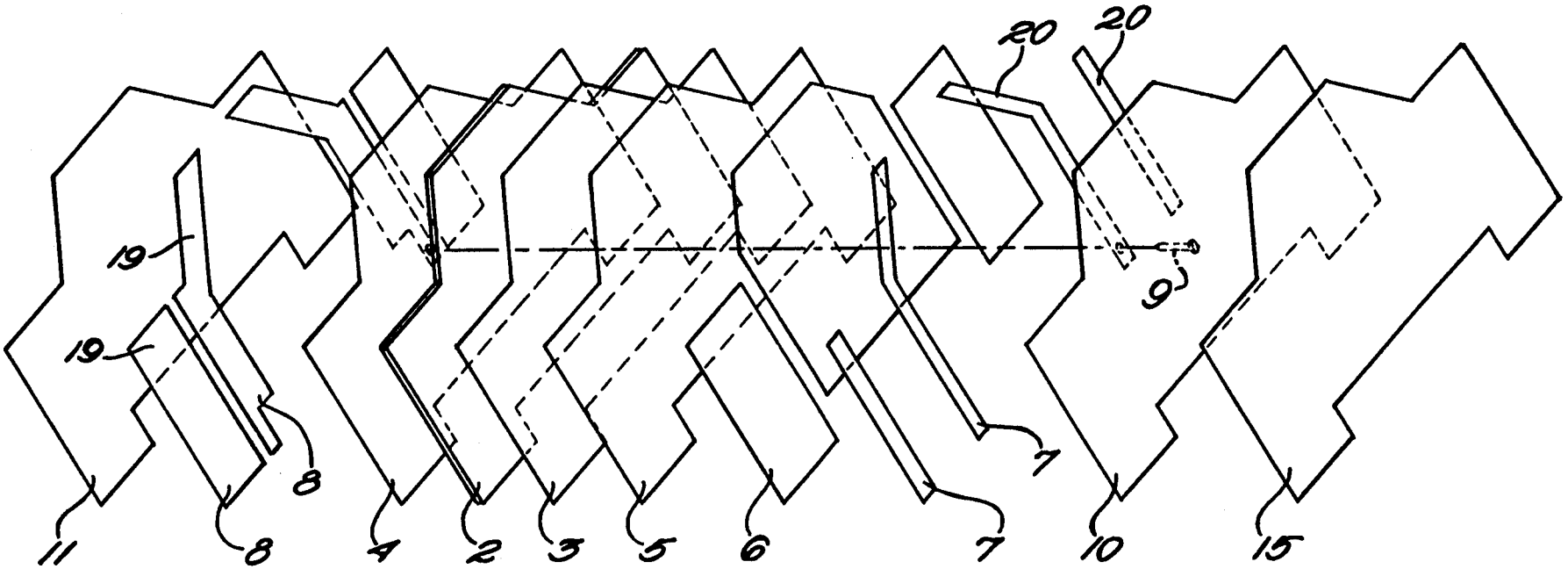
FIG. 1 is an exploded view of the preferred embodiment depicting schematically the fabrication process steps.

FIG. 1 schematically depicts the assembly steps in fabricating a Thermal Integrated Target 1. The target is constructed of a structural sheet 2 comprised of is a light weight, resin impregnated wooden board. The preferred wooden board is orientated strand board which is available in very large sheets, generally larger than plywood is available, from Georgia Pacific. Oriented strand board is formed from 1 to 5 inch planar strips of wood glued and compressed into a board with phenolic resin. Weatherability of the oriented strand board is pretty good on its own, and phenolic resins have been found to be suitable for electrical applications, such as circuit boards, in allied fields. The oriented strand board is sufficiently strong such that thicknesses of ⅜" are adequate for 8×12 foot targets. Because there is no grain, the oriented strand board holes very cleanly.

The front of the structural sheet 2 is coated with a flame retardant-water sealant 3. A wood sealer with a flame retardant, such as a phosphorous wax, is preferred.

The rear of the structural sheet 2 is coated with a flame retardant-water sealant 4.

The front of the structural sheet 2 is coated with an electrically insulative coating, the first frontal insulative coating 5. An epoxy enamel is preferred, and a fire retardant enamel consisting of a brominated epoxy resin containing antimony oxide has been found to yield the best results. The brominated epoxy makes electrical tracking, which can occur as the target sustains damage, manageable. Electrical tracking carbonizes the structural sheet and tends to initiate fire. In addition to preventing electrical tracking, epoxy enamel doesn't react or interact with zinc which is in the conductive coating or with or the nickel in the resistive coating.

To the front of the structural sheet 2, on the first frontal insulative coating 5 is applied the resistive coating 6 which heats up when an electric current, either AC or DC, passes through. The resistive coating 6 is applied in patterns that will recreate the thermal signature on the target representative of the simulated object. It has been observed that another technique for minimizing electrical tracking is to apply a second resistive coating 6, with the second coating on top of the conductive coating 7. The preferred resistive coating material is comprised of powered nickel dispersed in a cellulose nitrate lacquer. The resistance of the lacquer can be changed by varying the concentration of nickel.

Figure 2:
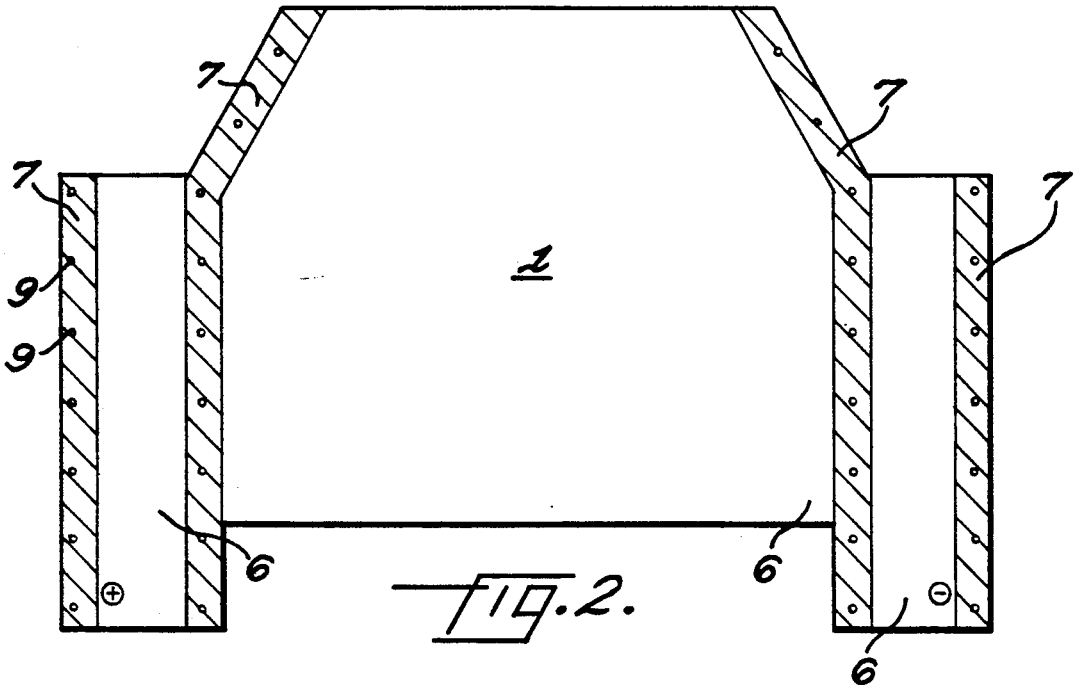
FIG. 2 is a frontal view of an Iraqi Personnel Carrier, where heat emitting regions are shown in white and the electrical bus, formed by the conductive coating—which distributes and redistributes the electricity across the resistive coating, is shown as left oblique parallel hatched lines.
Figure 4:
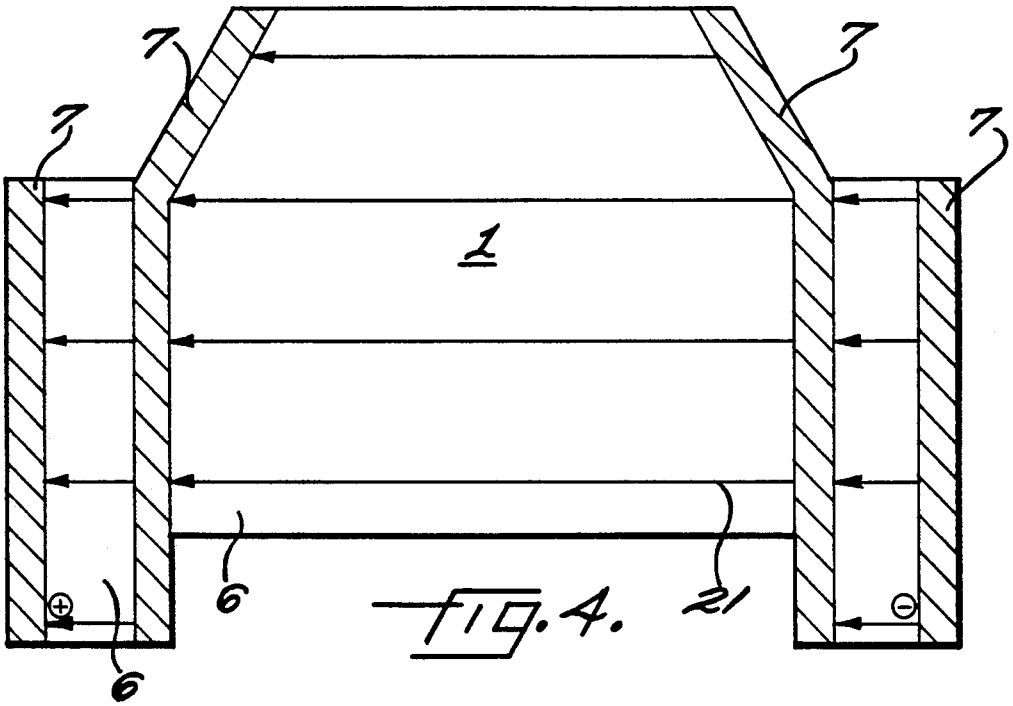
FIG. 4 is a frontal view of the target shown in FIG. 3 showing the electrical flow.

To the front of the structural sheet 2, on the first frontal insulative coating 5 and in electrical contact with the resistive coating 6 is applied the frontal conductive coating 7, which serves to distribute, as an electrical bus, the current to the various patterns of heat emitting resistive coating 6. FIG. 2 shows how the resistive and conductive coatings would be applied to simulate an Iraqi personnel carrier. FIG. 4 shows how the frontal electrical bus 20 serves to distribute and then redistribute the current as it traverses across the face of the target. The electric current flux is shown as arrowed lines 21. The preferred material for the frontal conductive coating 7 is zinc, which is applied using an air spray of zinc atomized in an electric arc. This coating technique is frequently referred to as sputtering.

Figure 3:
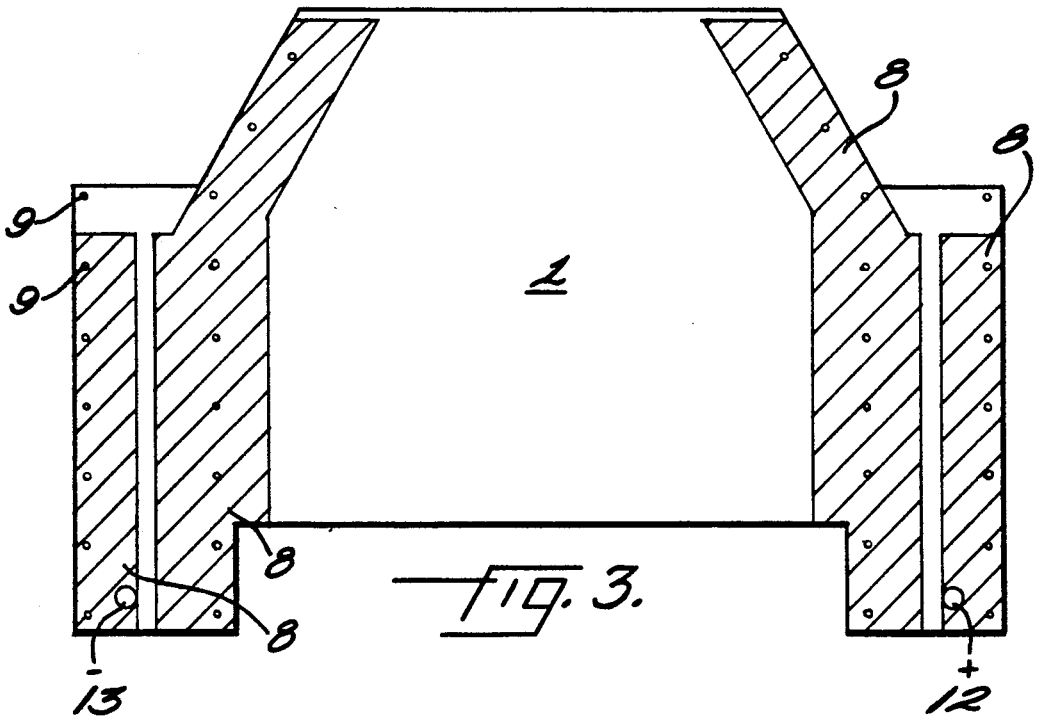
FIG. 3 is a rear view of the Iraqi Personnel Carrier shown in FIG. 2 illustrating the use of a broad band of conductive coating, shown as right oblique parallel hatched lines.

Backing up the frontal electrical bus 20, on the face of the target 1 is a much wider band of conductive coating, which is coated as an open mesh, so as to reduce the required total metal deposit. The rear conductive coating 8 forms the rear electrical bus 19. FIG. 3 depicts the relative arrangement and size of the electrical bus as seen from the back of the target. As in FIG. 2 the conductive coating is shown as oblique parallel hatch lines.

Referring again to FIG. 1, the rear electrical bus 19 and the frontal electrical bus 20 are connected multiple times using conductive elements 9. The preferred conductive elements 9 are zinc clad nails.

The target 1 is connected to a power supply via a pair electrical terminals shown in FIG. 3 as the positive terminal 12 and the negative terminal 13. The terminals 12 and 13 are connected to the frontal and rear electrical busses 20 and 19 located respectively on both the left and right sides of the target show in FIG. 3, in general, and low and out of harms way. Zinc clad bolts have been found to be suitable for terminals.

To the front of the structural sheet 2, covering the resistive coating 6 and the frontal conductive coating 7, there is a second frontal insulative coating 10. To the rear of the structural sheet 2, covering the rear conductive coating 8, there is a coating of enamel paint 11. The insulative coating 10 is preferably comprised of the same epoxy enamel as the first frontal insulative coating 5.

To the front of the structural sheet 2, covering the resistive coating 6, the frontal conductive coating 7, and the second frontal insulative coating 10 there is applied a coating of enamel paint 15 to give the target 1 the desired color and further improve weather resistance. This coating of enamel paint 15 is to non-reflective lazer originated light.

Figure 5:
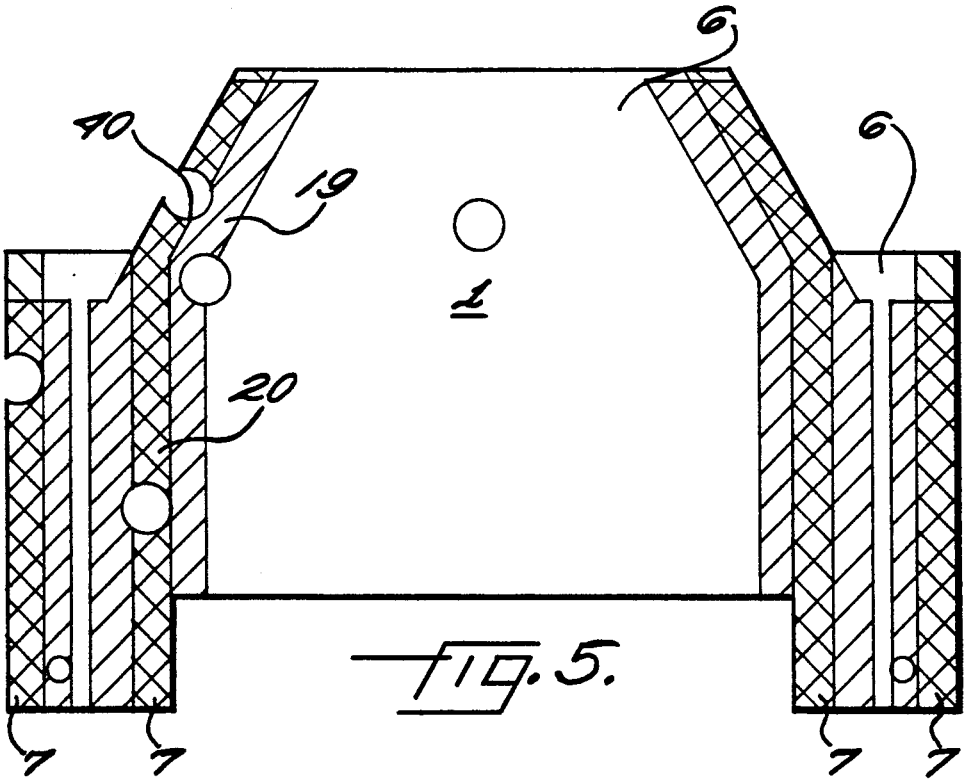
FIG. 5 is a view of the target shown in FIG. 2, that depicts the relative position of the front and rear conductive coatings, where the target has been partially destroyed in gunnery practice. Even though there are several crucial pieces of the electrical bus destroyed, the target is still capable of simulating the thermal signature of an Iraqi Personnel Carrier. The conductive coating on the front side of the target which overlaps the conductive coating on the rear is shown as cross-hatched lines to illustrate how the current would shunt a hole.

FIG. 5 illustrates how the present invention, a thermal integrated target, can still produce a signature thermal image even after sustaining several hits. The rear electrical bus 19 enables the current to be properly distributed to the resistive coating 6 even though a section of the frontal electrical bus 20 has been blown away. The current circumvents the hole 40 by using the rear electrical bus 19.

Figure 6:
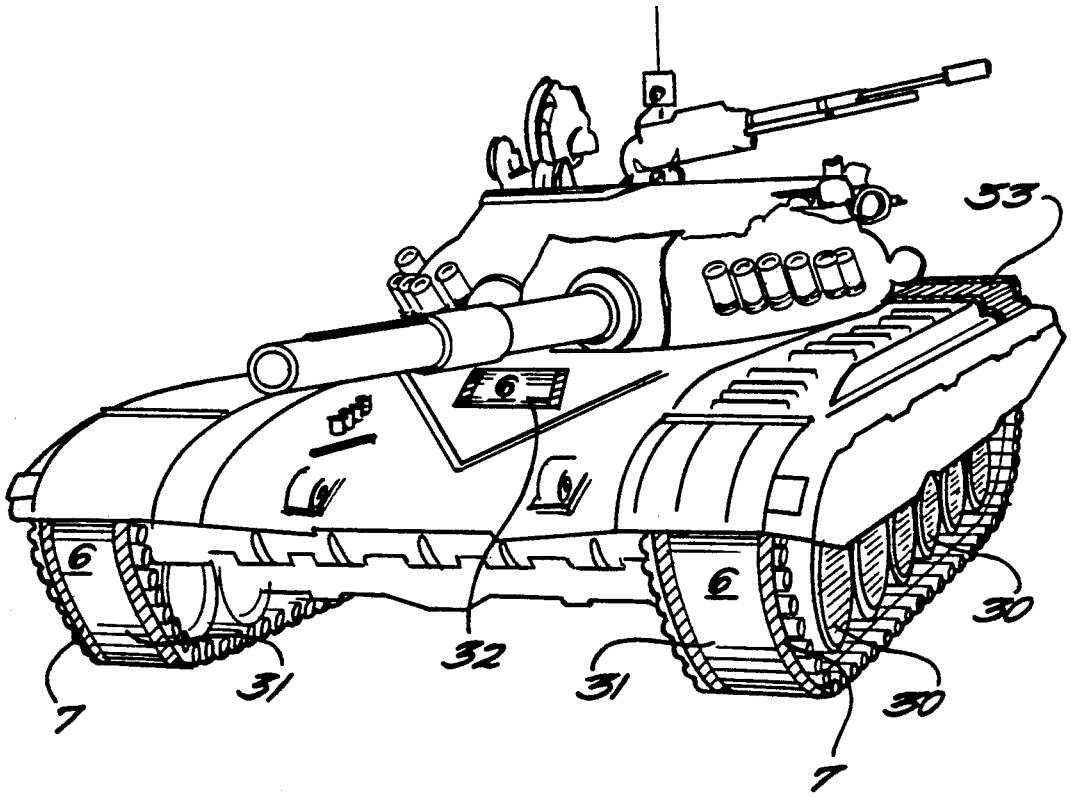
FIG. 6 is a perspective view of a mock-up of a Soviet T-72 tank, which is used as a training aid in Visual Recognition, that has been fitted with the correct thermal signature using appropriately applied resistive and conductive coatings to simulate the tank's thermal signature.

FIG. 6 is a perspective view of a target, sometimes called a VISMOD, used principally for visual recognition and lazer gunnery practice. The tank is constructed of reinforced fiberglass, which itself is structural, weather and fire resistant, and electrically insulative, such that the thermal signature can be created directly on the construction substrate using only the resistive and conductive coatings. The thermal signature for the tank consists of heated wheel hubs 30, tank treads 31, driver's periscope 32, and the engine exhaust 33. The resistive coating is applied to those areas that are to generate heat, and then opposing bands of conductive coating are applied such that an electric current is set up in the resistive coating. A power supply delivers power via wire and terminals to the conductive coating. The resistive coating 6 is shown as gray shading, and the conductive coating 7 as oblique parallel hatching.

In summary, through the utilization of the system of electrical coatings, whether all or a portion of the coatings are required, the instant invention is a facile, practical, inexpensive method for producing a thermal signature on new disposable targets, new reuseable targets or existing targets, where a target is anything that one may wish to produce a thermal image on. Through the judicious selection of electrical coatings on of a structural sheet that is electrically insulative, and electrically resistive and a conductive coatings; a thermal signature can be produced using relatively familiar coating techniques. Paint sprayers or paint brushes are suitable for application of the resistive coating. There are no contour limitations or specially fabricated wire resistor assemblies or laminates required, and, in fact, modifications using essentially unskilled laborers, in the field are feasible.

The process of creating a signature thermal image enables the external surface of an object, an object that is not intrinsically heat producing, to radiate thermal energy just like the surface of something that normally is heat producing, for instance like the surfaces on motorized equipment near the motor. These surfaces are typically several degrees, at least 5 to 20 degrees, hotter than the ambient temperature. The instant invention enables an external surface of an object to be converted to a thermally radiant surface. An advantage of the process is that this conversion does not require that the entire object be heated, but only the external surface. This enables much faster heatup, and much lower energy consumption since essentially only a thin layer of resistive coating on the external surface is being heated. Also, as stated above, the process is relatively easy to preform, and can be adopted to existing as well new training aids. The process is comprised of the following steps. Prepare the external surface of the object to make it electrically and thermally insulative. Emphasis on electrically insulative. Epoxy coatings, as previously reported have been found to give good results. Depending on the expectation of live fire, fire retardants are added accordingly. In general, good weather resistance is also a consideration. Next, the resistive coating is applied to the external surface that is to become thermally radiant. The metal content in the resistive coating is adjusted upward, as well as the total thickness of the coating, to handle more current. Electrical busses, which distribute the current to and from the resistive coating, are formed using a first and a second conductive coating, which are in contact with the coating, but do not touch each other as this would act as an electrical short around the resistive coating. Alternating (60 cycle/second) or direct current appear to work equally as well, and can used interchangeable. The two terminals on the power supply are connected to the first and second conductive coatings, and as soon as current starts flowing, the resistive coating heats up. For thermally radiant integrated targets, it is desired that within 10 seconds the surface has heated 20 degrees, where it starts attaining equilibrium with the ambient conditions. The instant invention easily accommodates this specification.

I claim:

1. A thermal target which produces and emits an infrared image that simulates heat emitting equipment or personnel, wherein said thermal target can sustain a number of ballistic hits and still produce a thermal image that is a signature of an object simulated by the thermal target, wherein said thermal target is comprised of:

a. A structural sheet, having a front side and a rear side, which is weather resistant and flame resistant;

b. An electrically insulative coating covering the front side of the structural sheet;

c. At least one electrically resistive coating, which heats, when subjected to an electric current, wherein said resistive coating is applied on the front side of the structural sheet in patterns, where said patterns imitate the thermal image created by the object being simulated;

d. An electrically conductive coating, which is in electrical contact with the resistive coating, where said conductive coating serves to distribute, like an electrical bus, the current to the patterns of infrared heat emitting resistive coating on the front side of the structural sheet;

e. An electrically conductive coating, on the rear side of the structural sheet, which forms a very wide rear electrical bus which backs up the electrically conductive coating on the front side of the structural sheet, wherein said electrically conductive coating on the rear side enables the current to shunt a region of the thermal target that has sustained a number of ballistic hits, therein maintaining the thermal image;

f. A multiplicity of conductive elements, dispersed throughout and traversing through the structural sheet, that connect the electrically conductive coating on the rear side to the electrically conductive coating on the front side;

g. A set of electrical terminals wherein each electrical terminal connects a pole of an electric current power supply to an electrical bus, the power supply therein being capable of producing a current in the resistive coating.

h. A second electrically insulative coating covering the front side of the structural sheet.

2. The thermal target claimed in claim 1 wherein said structural sheet is comprised of oriented strand board where said oriented strand board has been throughly coated on both sides with a weather proofing sealant containing a fire retardant.

3. The thermal target claimed in claim 2 wherein the electrically insulative coating consists of a brominated epoxy resin and antimony oxide.

4. The thermal target claimed in claim 3 wherein said electrically resistive coating consists of powered nickel dispersed in cellulose nitrate.

5. The thermal target claimed in claim 1 wherein said electrically conductive coating consists of zinc atomized in an electric arc which is then blown on to the structural sheet.

6. A thermal target which produces and emits an infrared image that simulates heat emitting equipment or personnel, wherein said thermal target can sustain a number of ballistic hits and still produce a thermal image that is a signature of an object simulated by the thermal target, wherein said thermal target is comprised of:

a. At least one structural sheet, having a front side and a rear side, which is weather resistant and flame resistant, and is not subject to splintering when impacted;

b. An electrically insulative coating, which is filled with a fire retardant, covering the front side of the structural sheet;

c. An electrically resistive coating, which heats, when subjected to an electric current, wherein said resistive coating is applied on the front side of the structural sheet in patterns, where said patterns imitate the thermal image created by the object being simulated;

d. An electrically conductive coating, which is in electrical contact with the resistive coating, where said conductive coating serves to distribute, like an electrical bus, the current to the patterns of infrared heat emitting resistive coating on the front side of the structural sheet;

e. An electrically conductive coating, on the rear side of the structural sheet, which is coated as a mesh, which forms a very wide rear electrical bus which backs up the electrically conductive coating on the front side of the structural sheet, wherein said electrically conductive coating on the rear side enables the current to shunt a region of the thermal target that has sustained a number of ballistic hits, therein maintaining the thermal image;

f. A multiplicity of conductive elements, dispersed throughout and traversing through the structural sheet, that connect the electrically conductive coating on the rear side to the electrically conductive coating on the front side;

g. A set of electrical terminals wherein each electrical terminal connects a pole of an electric current power supply to an electrical bus, the power supply therein being capable of producing a current in the resistive coating.

h. A second electrically insulative coating, which contains a fire retardant, covering the front side of the structural sheet.

i. A weather proofing paint coating covering the rear side of the structural sheet;

j. A weather proofing paint, appropriately applied on the front side of the structural sheet, to simulate a camouflaged object.

7. A process for converting an external surface of an object wherein said external surface nominally is not heat producing, to a thermally radiant surface, wherein said thermally radiant surface simulates the surface of equipment or personnel which intrinsically are heat producing, wherein said thermally radiant surface does not substantially heat the object, wherein said thermally radiant surface is relatively thin and therefore has a very low heat capacity and becomes radiant after passing an electric current for a only few seconds, said process being comprised of the steps of:

a. preparing the external surface to make it electrically and thermally insulative, if it is not already, through the application of at least one coating of an epoxy resin enamel;

b. applying, to the external surface, at least one resistive coating, wherein said resistive coating is an organic polymer based lacquer in which is dispersed a powered metal or alloy, wherein said powered metal or alloy is resistively conductive;

c. applying, in physical and electrical contact with a portion of a perimeter of the resistive coating, a first conductive coating wherein said first conductive coating is largely comprised of a sputtered metal that is electrically conductive, wherein at any given instant, said first conductive coating is in electrical contact with one pole of a power source;

d. applying, in physical and electrical contact with an alternative portion of a perimeter of the resistive coating—but not touching the first conductive coating, a second conductive coating wherein said second conductive coating is largely comprised of a sputtered metal that is electrically conductive, wherein at any given instant, said second conductive coating is in electrical contact with an opposing pole of the power source;

e. using the first conductive coating and the second conductive coating as conduits, passing an electric current through the resistive coating, which in turn generates heat.

8. The process as claimed in claim 7 wherein the preferred epoxy resin enamel is a brominated epoxy resin and antimony oxide.

9. The process as claimed in claim 8 wherein the preferred resistive coating is powered nickel dispersed in cellulose nitrate.

10. The process as claimed in claim 9 wherein the preferred first conductive coating and the second conductive coating are zinc atomized in an electric arc which is then blown on to the external surface.

* * * * *